US006427772B1

(12) United States Patent
Oden et al.

(10) Patent No.: US 6,427,772 B1
(45) Date of Patent: Aug. 6, 2002

(54) ELECTRONIC REFRIGERATION CONTROL SYSTEM

(75) Inventors: Kenneth Woodward Oden, Charles Town; Glenn Decker Selfridge, Martinsburg, both of WV (US)

(73) Assignee: Royal Vendors, Inc., Kearneysville, WV (US)

( * ) Notice: Subject to any disclaimer, the term of this patent is extended or adjusted under 35 U.S.C. 154(b) by 0 days.

(21) Appl. No.: 09/653,198

(22) Filed: Aug. 31, 2000

Related U.S. Application Data

(62) Division of application No. 08/637,593, filed on Apr. 25, 1996, now abandoned, which is a continuation of application No. 08/322,978, filed on Oct. 13, 1994, now abandoned.

(51) Int. Cl.[7] ..... F25B 29/00

(52) U.S. Cl. ..... 165/232; 165/233; 165/254; 165/259; 165/263; 165/11.1; 62/131; 62/155; 62/157; 62/158; 62/126; 221/150 R; 221/150 HC

(58) Field of Search ..... 165/232, 233, 165/254, 259, 263, 11.1; 62/158, 155, 126, 131, 157; 221/150 R, 150 HC

(56) References Cited

U.S. PATENT DOCUMENTS

| | | | | | |
|---|---|---|---|---|---|
| 2,724,576 | A | * | 11/1955 | Jacobs | 165/263 |
| 2,724,577 | A | * | 11/1955 | Murphy | 165/263 |
| 2,780,441 | A | * | 2/1957 | Rhodes | 165/263 |
| 3,518,841 | A | | 7/1970 | West, Jr. | |
| 4,060,400 | A | * | 11/1977 | Williams | 62/162 |
| 4,297,852 | A | | 11/1981 | Brooks | |
| 4,347,710 | A | * | 9/1982 | Ibrahim | 62/155 |
| 4,417,450 | A | | 11/1983 | Morgan, Jr. et al. | |
| 4,448,346 | A | * | 5/1984 | Kuwaki et al. | 62/158 |
| 4,741,178 | A | * | 5/1988 | Fujiu et al. | 62/198 |
| 4,745,629 | A | | 5/1988 | Essig et al. | |
| 4,834,169 | A | * | 5/1989 | Tershak et al. | 165/263 |
| 4,841,738 | A | * | 6/1989 | Katsuki et al. | 62/158 |
| 4,850,198 | A | | 7/1989 | Helt et al. | |
| 4,903,501 | A | | 2/1990 | Harl | |
| 4,916,912 | A | | 4/1990 | Levine et al. | |

(List continued on next page.)

FOREIGN PATENT DOCUMENTS

| | | | |
|---|---|---|---|
| GB | 2 254 452 | | 10/1992 |
| JP | 2-14396 | * | 1/1990 |
| JP | 3-149691 | * | 6/1991 |
| JP | 5-46861 | * | 2/1993 |
| JP | 6-4760 | * | 1/1994 |
| JP | 6-12556 | * | 1/1994 |

*Primary Examiner*—John K. Ford
(74) *Attorney, Agent, or Firm*—Jacobson Holman, PLLC

(57) ABSTRACT

The present invention is direct to a system and method for electronically controlling the refrigeration and/or heating of the product storage compartment in a vending machine. The system includes a temperature sensor for sensing the temperature in the product storage compartment, and a door sensor for sensing whether the door is open or closed. The control method includes the steps of activating a defrost mode, which is a timed period with no heating or cooling activity, when the door to the vending apparatus is open. The defrost mode is also activated whenever the cooling element has been running continuously for several hours. Further, the control method includes a step of cycling the cooling element "on" whenever a predetermined high temperature is reached. When the cooling element is "off" for more than 6 hours and the predetermined high temperature has not been reached, the heater is turned "on" to prevent the products in the vending machine from freezing.

5 Claims, 5 Drawing Sheets

U.S. PATENT DOCUMENTS 4,932,217 A 6/1990 Meyer
4,970,496 A 11/1990 Kirkpatrick
5,003,786 A * 4/1991 Fudono et al. ..... 62/126
5,046,324 A 9/1991 Otoh et al.
5,123,252 A * 6/1992 Harrison ..... 62/126
5,224,355 A 7/1993 So et al.
5,228,300 A 7/1993 Shim
5,231,844 A 8/1993 Park
5,263,332 A 11/1993 Park
6,223,817 B1 * 5/2001 Oden et al. ..... 165/232

* cited by examiner

ELECTRONIC REFRIGERATION CONTROL SYSTEM

This is a divisional of application Ser. No. 08/637,593 filed Apr. 25, 1996 now abandoned which in turn is continuation of application Ser. No. 08/322,978, filed Oct. 13, 1994, now abandoned.

BACKGROUND OF THE INVENTION

1. Field of the Invention

The present invention is directed to a system and method for electronically controlling the refrigeration and/or heating of the product storage compartment in a vending apparatus.

2. Related Art

Currently, vending machines have widespread application and utilization. Vending machines can be found not only in restaurants and other eateries, but also both inside and outside such facilities as offices, recreation centers, hospitals, gasoline stations, and apartment complexes. Because of their location, vending machines often experience both high and low levels of usage over a period of time. Further, such machines may be exposed to extremes of temperature and humidity for extended periods. Some vending machines are run for so long that ice and frost occur in the machines even though the products to be dispensed are warm.

When a vending machine is exposed to extremely cold temperatures, its cooling system should not be running continuously. In fact, prolonged periods of cold weather can freeze the products in the vending machine.

Moreover, when a vending machine door is open for loading or servicing, continuing to run the machine's compressor may cause problems in normal operation.

In the prior art, various types of systems have been proposed and implemented to optimize vending machine operation under varying conditions. For example, U.S. Pat. No. 5,231,844 to Park discloses a refrigerator defrost control method in which the refrigerator is defrosted by comparing a sensor temperature in the refrigerator with a predetermined temperature during a defrost period. This defrost control method includes sensing the open/closed conditions of the refrigerator doors, and activating a defrost heater when the doors are closed.

U.S. Pat. No. 5,228,300 to Shim discloses an automatic refrigerator operation control method that includes controlling the temperature setting of a chamber; defrost cycling; and the operation of a compressor and fan motor according to the frequency of the door being opened and closed and to the open time of the door.

U.S. Pat. No. 5,046,324 to Otoh, et al. shows a defrosting controller for refrigeration systems. The controller determines a frost melting period from the measurements of the evaporator temperature during defrosting by means of an evaporator temperature sensor.

U.S. Pat. No. 4,932,217 to Meyer shows a process for controlling a heater; particularly, a defrost heater for refrigeration plants. In this process, the temperature of the room to be heated is measured at intervals of time and in each case a measured temperature value is stored.

U.S. Pat. No. 4,916,912 to Levine, et al. shows a heat pump with adaptive frost determination functions.

U.S. Pat. No. 4,903,501 to Harl discloses a refrigerator air-control heated baffle.

U.S. Pat. No. 4,850,198 to Helt, et al. discloses a refrigerator compressor control method involving momentarily energizing the compressor after extended off periods.

U.S. Pat. No. 4,745,629 to Essig, et al. discloses an improved duty-cycle timer that provides a duty-cycle control signal having alternate "on" and "off" intervals of different logic states. In one embodiment of this invention, the duty-cycle timer controls operation of a refrigeration circuit defrost mechanism.

U.S. Pat. No. 3,518,841 to West, Jr. discloses a household refrigerator apparatus that includes an evaporator automatically defrostable through use of an electric heating element energized at varying timed intervals.

In comparison to the present invention, devices and systems known in the prior art, such as those discussed above, do not directly address or solve the problems to which the present invention is directed but rather suffer from those same problems and disadvantages. In particular, conventional refrigeration control systems suffer from unnecessary compressor cycling when the refrigeration system attempts to start before pressures have equalized in the evaporator and the condenser. Also, conventional control systems do not effectively maintain refrigerated compartment temperature when outside temperatures are extremely cold for extended periods. Instead, such systems remain unnecessarily idle, with the compressor off, for periods in excess of several hours, thereby allowing ambient conditions to determine the refrigerated compartment temperature. Even further, the conventional refrigeration control systems in the prior art do not provide service personnel any way to efficiently troubleshoot the vending machines.

SUMMARY OF THE INVENTION

One main object of the present invention is to provide a system and method for efficiently controlling the refrigeration system (i.e., the compressor and its related components) and heating element of a vending machine. In particular, a specific object of the present invention is to provide a system and method of controlling a vending machine so as to prevent both unnecessary cycling of the compressor and ineffective maintenance of the refrigerated compartment temperature under extreme operating conditions. The present invention includes specific features that are lacking in the teachings of the prior art.

The features of the present invention include the ability to activate a timed defrost mode with no heating or cooling activity, and the ability to use an electric heater to prevent products in the vending machine from freezing when outside temperatures are extremely low. Further, the present invention includes a logic test with temperature sensing to determine both ambient conditions and controlled cabinet temperature.

Another object of the present invention is to provide an electronic control system that allows service personnel to efficiently troubleshoot problems in the vending machine. In particular, the system provides service personnel an electronic memory that stores information on error conditions and a display for showing the cabinet temperature at the sensor location.

Overall, a main object of the present invention is to provide a system and method for controlling the temperature of a vending machine more efficiently and reliably.

BRIEF DESCRIPTION OF THE DRAWINGS

The invention is better understood by reading the following detailed description of the preferred embodiment with reference to accompanying drawing figures, in which like reference numerals refer to like elements throughout, and in which.

DETAILED DESCRIPTION OF THE PREFERRED EMBODIMENTS

Figure 1:
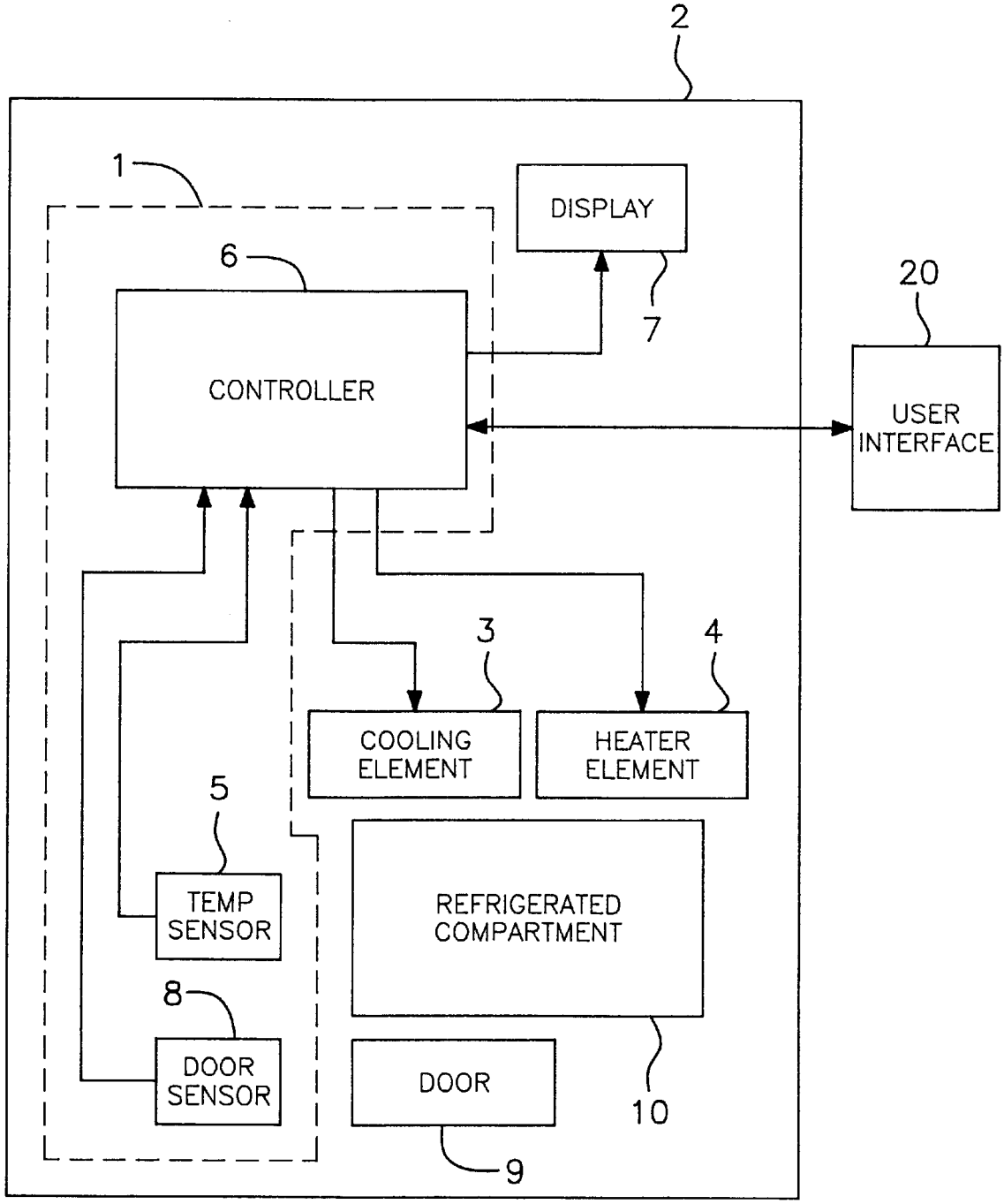
FIG. 1 illustrates a circuit block diagram of one embodiment of the hardware implementation of the present invention.

In describing preferred embodiments of present invention illustrated in the drawings, specific terminology is employed for the sake of clarity. The invention is not intended to be limited to the specific terminology so selected, however, and it is to be understood that each specific element includes all technical equivalents that operate in a similar manner to accomplish a similar purpose.

In one embodiment, the present invention as illustrated in FIG. 1 is generally directed to a system 1 for controlling the operation of a cooling element 3 and a heater element 4 of a vending machine 2. In this embodiment, the cooling element 3 is based on a vapor compression refrigeration cycle comprising a refrigeration fluid compressor and its associated components, while the heater element 4 is a silicon sheet heater bonded to a metal mounting bracket. The heater element 4 also has a built-in independent over-temperature safety control. A temperature sensor 5 (for example, a National Semiconductor LM34DZ precision Fahrenheit temperature sensor) senses the temperature in the refrigerated compartment 10 of the vending machine 2, and inputs a temperature signal to a controller 6. The controller 6 in this embodiment is based on a Motorola 68HC11E1 8-bit processor with one of its eight analog-to-digital inputs being used to receive signals from the temperature sensor 5.

Figure 2:
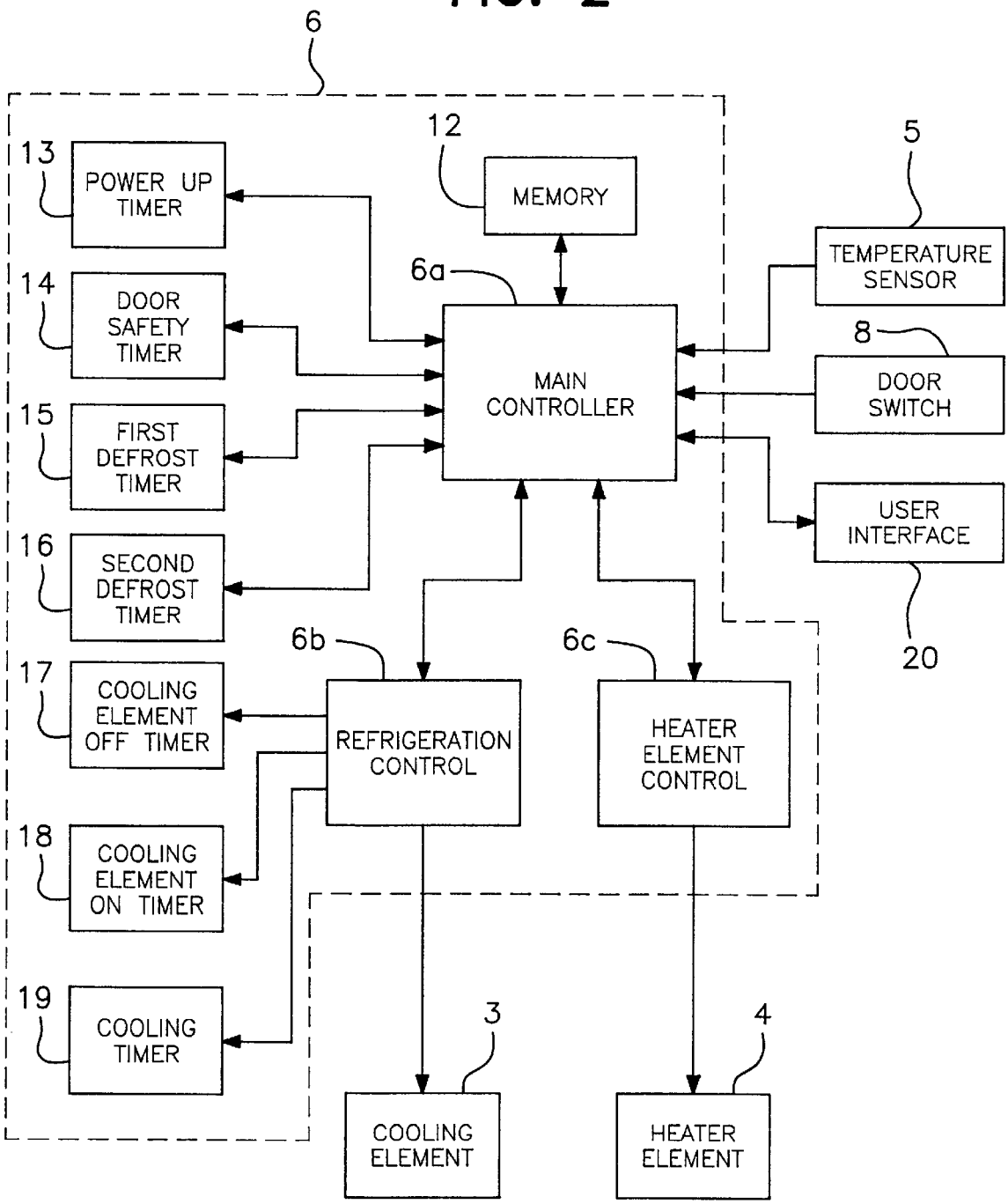
FIG. 2 illustrates a circuit block diagram of the controller of the first embodiment of the present invention as shown in FIG. 1.

As shown in FIG. 2, the controller 6 is organized as a main controller 6*a* with a refrigeration control 6*b* and a heater element control 6*c*. In this preferred embodiment, the main controller 6*a*, refrigeration control 6*b* and heater element control 6*c* are implemented as the operating software of the controller 6. Thus, the controls 6*a*–6*c* are, for example, first stored in ROM memory and then loaded into the RAM memory of a processor in the controller 6 when the controller 6 is first initialized. As will be explained below, the controller 6 also incorporates a memory 12 (for example, a SGS Thompson M27c512 64k×8 bit EPROM) for storing the operating system of the controller 6, the parameters for various timers and temperatures used in the operation of the system, the status of various warning flags, as well as temperature readings made by the temperature sensor 5. A user interface 20 allows service personnel to access the controller, and thereby the memory 12, in order either to check the status of the warning flags or to change the operating parameters in the system. The user interface can be a hand-held terminal (e.g., a laptop computer) that connects to the controller through a TTL level RS-232 port for DEX transmissions. A display 7 is used to show the temperature of the refrigerated compartment of the vending machine. The display 7 can be an alphanumeric display using LEDs, for example. A sensor 8 connected to the door 9 of the refrigerated compartment 10 is used to monitor the opening and closing of the door 9. The sensor 8 in this embodiment is a switch (e.g., a momentary contact switch) that is activate/deactivated depending on the opening/closing of the door 9.

The various timers 13–19, in this preferred embodiment, are also software implemented in that they constitute software logic routines that are accessed as required. Their parameters are initially stored in the memory 12, and the timers can be operated, as an example, based on the internal clock of the processor in the controller 6. The internal clock provides the base timing pulses which can then be counted and translated for the various timer operations.

In operation, the refrigeration control 6*a* cycles the refrigerated compartment of the vending machine between a refrigeration cut-in or high temperature and a refrigeration cut-out or low temperature. The refrigeration cut-in and cut-out temperatures can be set by the manufacturer to have a limited range of adjustability; both temperatures are then stored in the memory 12. For example, the refrigeration cut-in temperature would be initially set to 41° F. by the manufacturer, and be adjustable between 45° F. and 39° F. On the other hand, the refrigeration cut-out temperature would be initially set at 29° F. and be adjustable between 34° F. and 24° F.

The heater element control 6*b* cycles between a heating cut-out or high temperature and a heating cut-in or low temperature. In the present embodiment, both the heating cut-out and cut-in temperatures are set by the manufacturer and are not adjustable; both temperatures also are stored in the memory 12. For example, the heating cut-out temperature would be set to 36° F., while the heating cut-in temperature would be set to 32° F.

The controller 6 is designed to produce five refrigeration and heating control modes for the vending machine. These modes are:

1. Defrost mode
2. Refrigeration mode with cooling element "off"
3. Refrigeration mode with cooling element "on"
4. Heating mode with heating element "off"
5. Heating mode with heating element "on"

Figure 3A:
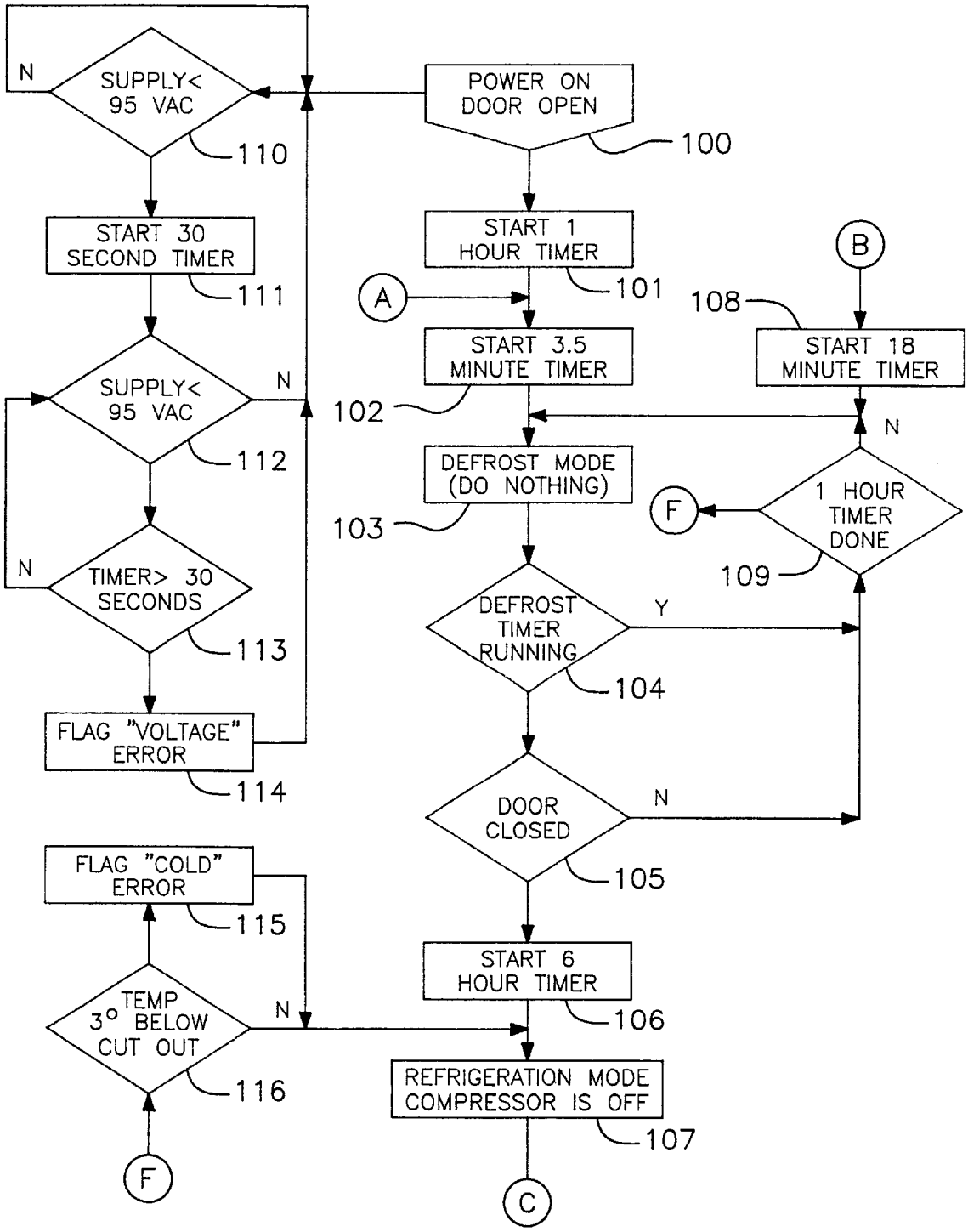
FIGS. 3*a*–3*c* together illustrate the logic diagram for the refrigeration control system of a preferred embodiment of the present invention.
Figure 3B:
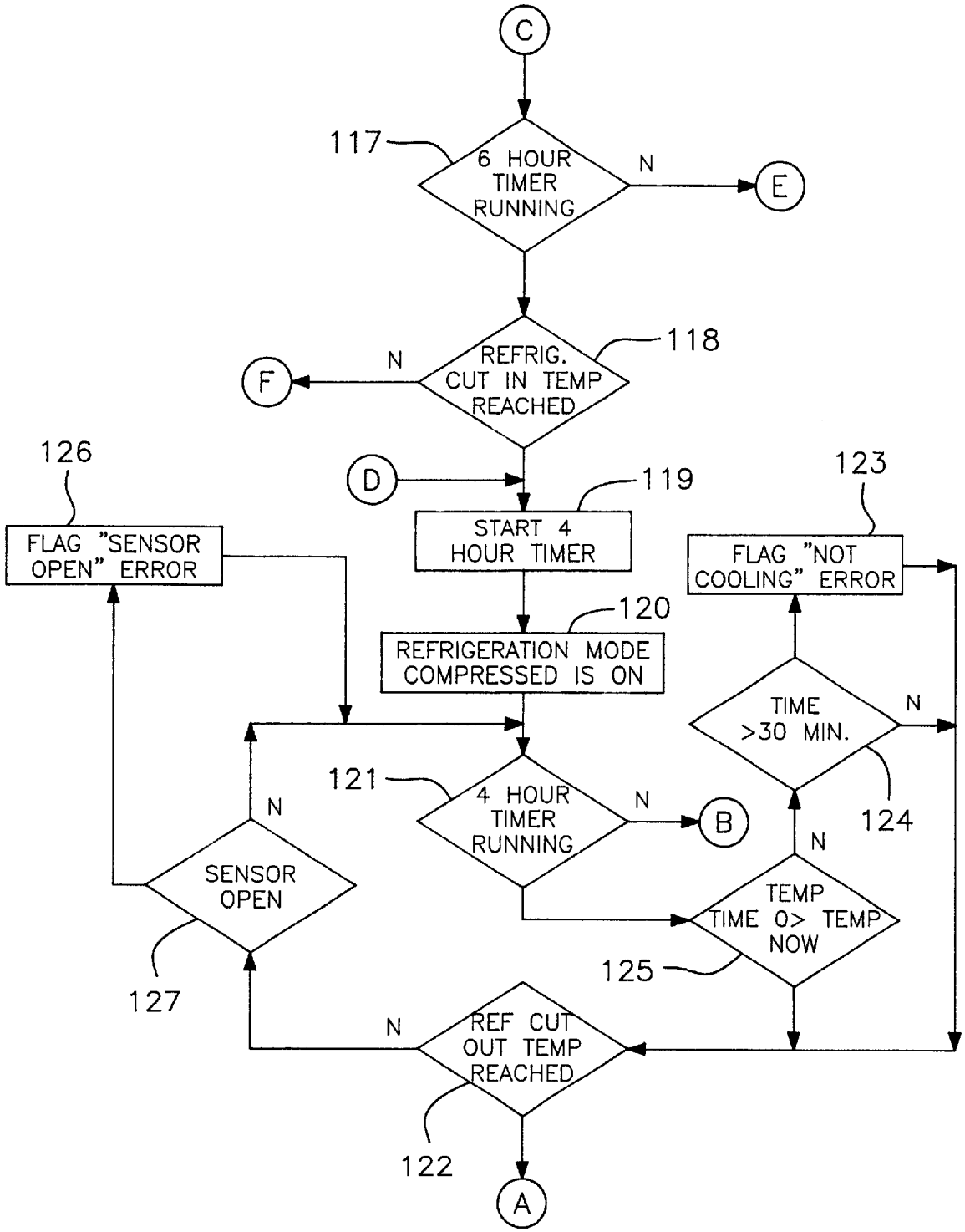
Figure 3C:
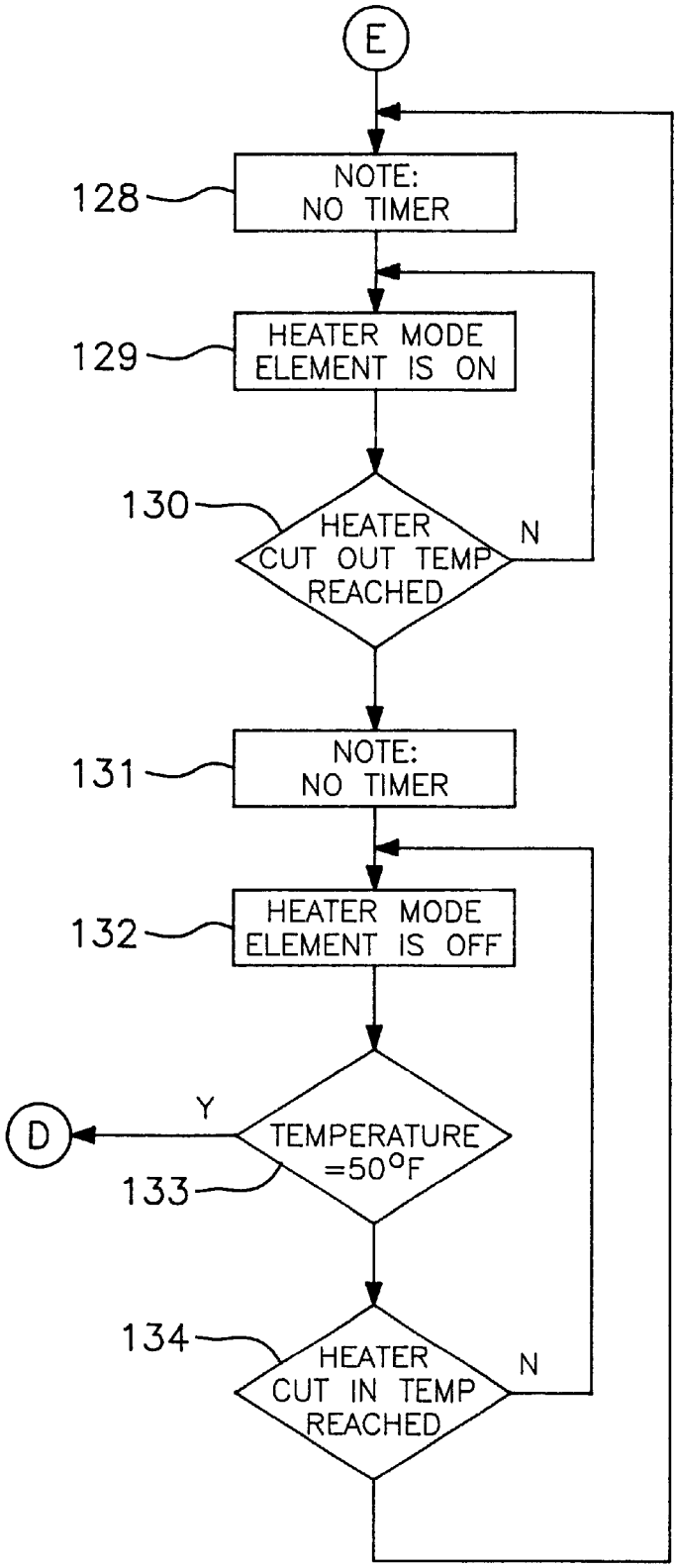

The defrost mode, a main feature of the present invention, is a timed period of inactivity wherein no active heating or cooling is performed by the system. As illustrated in FIGS. 3*a*–3*c*, when the door 9 of the vending machine 2 is opened (Step 100), the door sensor 8 is activated and a door safety timer 14 begins running (Step 101) (e.g., for one hour) to signal that the door 9 is open. A first defrost timer 15 (Step 102) then starts to run (e.g., for 3.5 minutes) to monitor the defrost period. If the door 9 is closed before the first defrost timer 15 runs out, the main controller 6*a* will detect the door 9 being closed through the door sensor 8 (Step 105). At that point, the main controller 6*a* will activate the refrigeration control 6*b* to initiate a refrigeration mode with the cooling element 3 "off" (Step 107). If, however, the first defrost timer 15 runs out before the door 9 is closed, the main controller 6*a* will first detect whether the door 9 is in fact closed using the door sensor 8 (Step 105). If not, the door safety timer 14 is checked to determine if it too has run out (Step 109). If the door safety timer 14 has run out, the temperature sensor 5 is checked to determine if the temperature in the refrigerated compartment 10 is a predetermined amount (e.g., 3°) below the refrigeration cut-out temperature defined in the memory 12. If so, a "cold" error flag is set in the memory 12 to indicate that such a condition has occurred. After setting the "cold" error flag or if the temperature is not detected to be below the refrigeration cut-out temperature, control reverts to the refrigeration control 6*b* in the refrigeration mode with the cooling element 3 "off" within a preset time; for example, 30 seconds.

The operation of the door safety timer 14 is used to monitor the door sensor 8. Should the door sensor 8 be defective, the main controller 6*a* would automatically transfer control to the refrigeration modes, starting with the mode having the cooling element 3 "off." This would allow the main controller 6*a* to monitor the temperature in the refrigerated compartment 10. For example, if a defective door sensor 8 was unable to detect the door 9 being open for an extended period of time or if the defective door sensor 8 signaled that the door 9 was closed while in fact it was open, the main controller 6*a* would revert control to the refrigeration modes in order to prevent a significant loss in temperature. On the other hand, if the defective sensor 8 instead signaled that the door 9 was open while in fact it was closed, the main controller 6*a* reverting control to the refrigeration control 6*b* in the refrigeration mode with the cooling element "off" (Step 107) would effectively ignore the erroneous signals and bypass the defective sensor 8.

A second defrost timer 16 with a second defrost period can be initiated when the cooling element 3 has been running continuously for a predetermined time period (e.g., 4 hours). As shown in FIG. 3*b* and as will be explained below, the refrigeration mode with the cooling element 3 "on" operates with a cooling element "on" timer 18 (Step 121). In this embodiment, that cooling element "on" timer 18 is set for four hours. If the four hours run out, the second defrost timer 16 is activated (See FIG. 3*a*) for, in this case, 18 minutes (Step 108). With the second defrost timer 16 activated, the second defrost period continues operation similar to the first defrost period. After that second defrost period is completed, control reverts to the refrigeration mode with the cooling element 3 "off."

In the two refrigeration modes, the cooling element 3 is cycled either "on" (Step 120) or "off" (Step 107). For the refrigeration mode with the cooling element "off," a cooling element "off" timer 17 is initiated in step 106 (e.g., 6 hours) and monitored (Step 117). During this time period, the refrigeration control 6*b* is constantly monitoring for the refrigeration cut-in temperature (Step 118) stored in the memory 12, and for the temperature of the refrigerated compartment 10 to reach the predetermined amount below the refrigeration cut-out temperature (Step 116) through the temperature sensor 7, as explained above. If the refrigeration cut-in temperature does occur as in Step 118, the refrigeration mode with the cooling element "on" operates as in Step 120. If the cooling element "off" timer 17 runs out without reaching the refrigeration cut-in temperature, the refrigeration control 6*b* will automatically assume that the outside ambient temperature is too low. Consequently, control will revert to the heater element control 6*c* with the heating. mode having the heater element 4 "on" to prevent the products in the vending machine from freezing, and the cooling element 3 from running when the outside ambient temperature is lower than the temperature of the refrigeration compartment 10.

As illustrated in FIG. 3*b,* in the refrigeration mode with the cooling element "on" as in Step 120, the cooling element "on" timer 18 (Step 119) is initiated (e.g., 4 hours) during which the refrigeration control 6*b* constantly monitors for the refrigeration cut-out temperature (Step 122) defined in the memory 12. The temperature of the refrigerated compartment 10 when the cooling element 3 is activated is recorded, and a cooling timer 19 is initiated to record the length of time of the cooling element 3 running. If the cut-out temperature is reached, the refrigeration mode cycles the cooling element "off" with the first defrost period (e.g., 3.5 minutes) as in Step 102 initiating the first defrost timer 15. Effectively, after cycling in the refrigeration mode with the cooling element "on," the cooling element 3 is turned "off" and the first defrost period is initiated before returning to the refrigeration mode with the cooling element "off." If the cooling element "on" timer 18 runs out (Step 121), the refrigeration control 6*b* assumes that the heat exchanger 11 has developed ice and the second defrost timer 16 begins to run with the second defrost period (e.g., eighteen minutes) as in Step 108.

While monitoring for the refrigeration cut-out temperature, the refrigeration control 6*b* also compares the current temperature of the refrigerated compartment 10 with the temperature measured when the cooling element 3 was activated and stored in the memory 12 (Step 125). In other words, the temperature at TIME 0 is the temperature of the refrigerated compartment when the cooling element 3 was initially turned "on." If the current temperature is less than the temperature at TIME 0, the refrigeration control 6*b* continues monitoring. If the current temperature is greater, the refrigeration control 6*b* determines if that condition of the temperature has lasted more than a predetermined time period stored in the memory 12 (e.g., thirty minutes) (Step. 124) based on the cooling timer 19. If the predetermined time period has not been exceeded, the refrigeration control 6*b* returns to monitoring for the refrigeration cut-out temperature (Step 122). If the time period has been exceeded, a "not cooling" error flag is set in the memory 12 to produce a warning. Afterward, the refrigeration control 6*b* again returns to monitoring.

Also while monitoring for the refrigeration cut-out temperature, the refrigeration control 6*b* monitors the condition of the temperature sensor 5. This operation is intended to determine if any defects (e.g., a defective sensor, broken signal wires) exist in connection with the temperature sensor 5. If the temperature sensor 5 is detected to be "open" or not transmitting any signals (Step 127), a "sensor open" error flag is set in the memory 12 to generate a warning (Step 126). If the temperature sensor 5 is not detected to be "open," or after the setting of the "sensor open" error flag, the refrigeration control 6*b* returns to monitoring the cooling element "on" timer 18 (Step 121).

In the two heating modes, an electric heating element 4 is cycled either "on" (Step 129) or "off" (Step 132). As shown in FIG. 3*c,* in the heating mode with the heating element "on" (Step 129), the heating element control 6*c* constantly measures for the heater cut-out temperature (Step 130) defined in the memory 12. If the heater cut-out temperature is reached, control transfers to the heating mode with the heating element "off"; the heater is turned "off" (Step 131).

In the heating mode with the heating element "off," the heating element control 6*c* constantly monitors for the predetermined heater cut-in temperature (Step 134) and a predetermined temperature (e.g. 50° F.) that transfers control to the refrigeration mode with the cooling element "on" (Step 133). If the heater cut-in temperature is reached as in Step 134, the heating element control 6*c* cycles the heating element 4 in the heating mode with the heating element "on" (Step 129). As noted in FIG. 3*c,* no timers are utilized in either of the heating modes.

Also illustrated in FIG. 3*a,* Steps 110 through 114 embody the "power up" sequence of the vending machine 2. As shown, when power is initiated (Step 100), the controller 6 monitors whether the supply voltage received by the vending machine 2 is less than the power voltage requirement (e.g., 95 VAC) of the vending machine 2 (Step 110). If the power voltage requirement has been reached, the controller 6 continuously monitors it. If not, a power-up timer (e.g., 30 seconds) is initiated to allow the voltage level to build up (Step 111). During this timer period, the controller 6 continuously determines whether the power voltage requirement is reached (Step 112). If the required voltage is reached, the controller 6 then switches to monitoring (Step 110). If not, the controller 6 checks the power-up timer 13 if it has run out (Step 113). While the power-up timer 13 is still running, the controller 6 will revert back to monitoring the buildup of the supply voltage (Step 112). If the power-up timer 13 has run out, a "voltage" error flag warning is set (Step 114); afterward, the controller reverts to monitoring the supply voltage (Step 110).

By virtue of the logical operation of the present invention, unnecessary cycling on the cooling element and/or its related components is prevented. For example, if a cooling element based on a compressor is used, the compressor can be prevented from starting before the pressures in its evaporator and condenser have equalized by the timed defrost period. Further, the logical operation prevents the ineffective control of the temperature under extreme ambient temperature conditions. The timed defrost period also eliminates the occurrence of evaporator icing when the vending machine products are warm.

Modifications and variations of the above-described embodiments of the present invention are possible as appreciated by those skilled in the art in light of the above teachings. For example, the structure and operation of the controller 6, such as the various timers, the refrigeration control, the heater element control and the memory, can all be embodied not only in hardware, but also in software. Instead of a cooling system based on a refrigeration fluid compressor with an evaporator and condenser, the present invention can also operate using thermoelectric or absorption cooling cycles. Also, the system can incorporate relay drivers and high-voltage relays (for example, a ULN relay driver with a 74HC595 serial input-to-parallel output shift register) in order to deliver the necessary voltage and current levels to the cooling element and heater element systems. Alternatively, the system can incorporate power electronic circuits designed to handle such high levels of power, in order to integrate the structure and features of the invention in a more compact device. Also, instead of interfacing using a user interface 20 to access the memory 12, user controls (i.e., switches, a keypad) can be built in with the controller 6 that could be used to signal the controller to display the information from the memory 12 on the display 7.

Consequently, it is therefore to be understood that, within the scope of the appending claims and their equivalence, the invention may be practiced otherwise than it is specifically described.

What is claimed is:

1. A system for electronically controlling the refrigeration and heating of a product storage compartment of a vending machine having a door, the system comprising:

a vending machine having a product storage compartment and a door to the product storage compartment;

a temperature sensor for sensing the temperature of the storage compartment;

a door sensor for detecting whether the door of the storage compartment is opened or closed;

a cooling element for refrigerating the storage compartment a heater element for heating the storage compartment; and an electronic controller connected to said temperature sensor, door sensor, cooling element, and heater element, said controller including refrigeration control means for controlling refrigeration of the storage compartment in one of a refrigeration mode with said cooling element in an ON state and a refrigeration mode with said cooling element in an OFF state, heating control means for controlling heating of the storage compartment in one of a heating mode with said heater element in an ON state and a heating mode with said heater element in an OFF state, and main control means for controlling defrosting of the storage compartment in a defrost mode with both said cooling element and said heater element in an OFF state, and for switching control between said refrigeration control means, said heating control means and said defrost mode based on signals from at least said temperature sensor and said door sensor, said main control means including a door safety timer for monitoring when the door of the storage compartment is open and a defrost timer for monitoring a time of the defrost mode.

2. A system for electronically controlling the refrigeration and heating of a product storage compartment as claimed in claim 1, the system further comprising:

a user interface connected to said electronic controller to access control data from said electronic controller.

3. A system for electronically controlling the refrigeration and heating of a product storage compartment as claimed in claim 1, wherein said refrigeration control means includes a cooling element OFF timer for monitoring a time of said cooling element being OFF, a cooling element ON timer for monitoring a time of said cooling element being ON and a cooling timer for monitoring a time of the temperature in the storage compartment dropping.

4. A system for electronically controlling the refrigeration and heating of a product storage compartment as claimed in claim 1, wherein said main control means includes a memory for storing temperature control data and timer data used in said main control means, said refrigeration control means and said heating control means, and error flag data generated by said electronic controller.

5. A system for electronically controlling the refrigeration and heating of a product storage compartment as claimed in claim 4, the system further comprising:

a user interface connected to said electronic controller to access the temperature control data, timer data and error flag data from said memory of said electronic controller.

* * * * *